United States Patent [19]

Holme

[11] 4,139,482

[45] Feb. 13, 1979

[54] COMBINATION OF A FATTY ACID AND AN N-SULFODICARBOXYLIC ACID ASPARATE AS COLLECTORS FOR NON-SULFIDE ORES

[75] Inventor: Rudolph N. Holme, Knoxville, Tenn.

[73] Assignee: American Cyanamid Company, Stamford, Conn.

[21] Appl. No.: 863,032

[22] Filed: Dec. 21, 1977

[51] Int. Cl.[2] ..... B03D 1/02

[52] U.S. Cl. ..... 252/61; 209/166

[58] Field of Search ..... 252/61; 209/166; 560/150, 151

[56] References Cited

U.S. PATENT DOCUMENTS

| | | | |
|---|---|---|---|
| 2,377,129 | 5/1945 | Christmann et al. | 209/166 |
| 2,438,092 | 3/1948 | Lynch | 560/151 |
| 3,830,366 | 8/1974 | Day et al. | 209/166 |

*Primary Examiner*—Harris A. Pitlick

*Attorney, Agent, or Firm*—William J. van Loo

[57] ABSTRACT

A collector combination of a fatty acid and an N-sulfodicarboxylic acid aspartate provides boostering action in the recovery of non-sulfide minerals.

6 Claims, No Drawings

COMBINATION OF A FATTY ACID AND AN N-SULFODICARBOXYLIC ACID ASPARATE AS COLLECTORS FOR NON-SULFIDE ORES

CROSS-REFERENCE TO RELATED APPLICATIONS

This application deals with a collector combination for non-sulfide ores and is related to application Ser. No. 862,995 filed on even date herewith which deals with a process of use.

This invention relates to a novel collector combination for use in the beneficiation of non-sulfide ores. More particularly, this invention relates to such a collector combination comprising a fatty acid derived from a vegetable or animal oil and an N-sulfodicarboxylic acid aspartate.

Froth flotation is the principal means of concentrating phosphate, barite, and fluorite ores as well as a host of other ores. Its chief advantage is that it is a relatively efficient operation at a substantially lower cost than many other processes.

Flotation is a process for separating finely ground valuable minerals from their associated gangue or waste or for separating valuable components one from another. In froth flotation, froth occurs by introducing air into a pulp of finely divided ore and water containing a frothing agent. Minerals that have a special affinity for air bubbles rise to the surface in the froth and are separated from those wetted by the water. The particles to be separated by froth flotation must be of a size that can be readily levitated by the air bubbles.

Agents called collectors are used in conjunction with flotation to promote recovery of the desired material. The agents chosen must be capable of selectively coating the desired material in spite of the presence of many other mineral species. Current theory states that the flotation separation of one mineral species from another depends on the relative wettability of surfaces. Typically, the surface free energy is purportedly lowered by the adsorption of heteropolar surface-active agents. The hydrophobic coating thus provided acts in this explanation as a bridge so that the particle may be attached to an air bubble. The practice of this invention, however, is not limited by this or other theories of flotation.

As a typical example of the beneficiation of non-sulfide ores, phosphate ore containing about 30% BPL (Bone Phosphate of Lime) $Ca_3(PO_4)_2$ is concentrated in very large tonnages from the Florida pebble phosphate deposits. The ore slurry from strip mining is sized at about 1 millimeter and the coarser fraction, after scrubbing to break up mud balls, is a finished product. The minus 1 mm. fraction is further sized at 35 and 150 mesh. The minus 150 mesh slime is discarded. From the sizing operation the +35 mesh material in thick slurry is treated with fatty acid, fuel oil and caustic ammonia, or other alkali and the resulting agglomerates are separated on shaking tables, spirals, or spray belts. The 35 × 150 mesh fraction is conditioned with the same type of reagents and floated by conventional froth flotation route. Not all the silica gangue is rejected by the fatty acid flotation, so the concentrate is blunged with acid to remove collector coatings, deslimed, washed of reagents and subjected to an amine flotation with fuel oil at pH 7–8. This latter flotation, sometimes called "cleaning", removes additional silica and raises the final concentrate grade to 75–80% BPL.

Although fatty acids are useful in the procedure described above and similar processes for the recovery of other non-sulfide ores, these acids are in short supply. This is because much of the fatty acids are derived from vegetable and animal oils which are edible and are increasingly diverted to nutritional uses. There exists, therefore, the need for collector materials which extend the use of fatty acids while providing high recovery and grade. The provision for such collector materials would satisfy a long-felt need and constitute a significant advance in the art.

In accordance with the present invention, there is provided a collector combination for non-sulfide minerals comprising from about 1 to about 99 weight percent of a fatty acid derived from a vegetable or aminal oil, said acid being present in hydrogen form or as an alkali metal or ammonium salt and, correspondingly, from about 99 to about 1 weight percent of an N-sulfodicarboxylic acid aspartate of the general formula

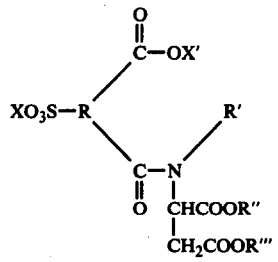

wherein X and X' are members of the group consisting of hydrogen and cationic salt-forming radicals, R is the residue of an aliphatic polycarboxylic acid, R' is a member of the group consisting of alkyl, alkoxyalkyl, and hydroxyalkyl radicals of from 8 to 20 carbon atoms and R'' and R''' are members of the group consisting of hydrogen, alkyl and cationic salt-forming radicals, said N-sulfodicarboxylic acid aspartate being in a form compatible with the form of said fatty acid.

Use of the specified collector combination provides unexpected improvements in recovery of valuable non-sulfide minerals at high grade (purity) levels under normal froth flotation conditions. The use of an N-sulfodicarboxylic acid aspartate in conjunction with the fatty acid reduces the total quantity of collector needed to provide a given level of recovery. Such use greatly reduces the requirements for fatty acid and thus frees more fatty acid for nutritional and other uses.

The first essential component of the collector combination of the present invention is a fatty acid derived from a vegetable or animal oil. Vegetable oils include babassu, castor, Chinese tallow, coconut, cottonseed, grapeseed, hempseed, kapok, linseed, wild mustard, oilicica, olive, ouri-ouri, palm, palmkernel, peanut, perilla, poppyseed, Argentine rapeseed, rubberseed, safflower, sesame, soybean, sugarcane, sunflower, tall, teaseed, tung and ucuhuba oils. Animal oils include fish and livestock oils. These oils contain acids ranging from six to twenty-eight carbon atoms or more and may be saturated or unsaturated, hydroxylated or not, linear or cyclic and the like. The acid may be in hydrogen form or as an alkali metal or ammonium salt.

The second essential ingredient is an N-sulfodicarboxylic acid aspartate of the general formula

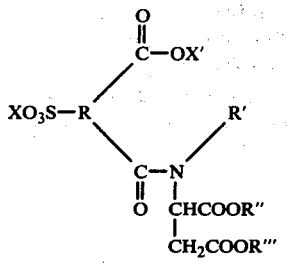

wherein X and X' are members of the group consisting of hydrogen and cationic salt-forming radicals, R is the residue of an aliphatic polycarboxylic acid, R' is a member of the group consisting of alkyl, alkoxyalkyl and hydroxyalkyl of from about 8 to 20 carbon atoms and R'' and R''' are members of the group consisting of hydrogen, alkyl and cationic salt-forming radicals. Preferred compounds are those in which R is the residue of succinic acid. Preferred species include tetrasodium N-(1,2-dicarboxyethyl)-N-octadecylsulfosuccinamate and tetrasodium N-(1,2-dicarboxyethyl)-N-octadecenyl sulfosuccinamate. The N-sulfodicarboxylic acid aspartate should be in a form that is compatible with the form of the fatty acid. Thus, the two components are compatible when they are both in free acid form or are both in appropriate salt forms.

The two components will be present in the combination in amounts such that the fatty acid constitutes from about 1 to about 99 weight percent and the N-sulfodicarboxylic acid aspartate constitutes, correspondingly, from about 99 to about 1 weight percent of said combination. A preferred composition is from about 97 to 90 weight percent fatty acid and, correspondingly, from about 3 to 10 weight percent of N-sulfodicarboxylic acid aspartate.

In using the collector combination of the present invention, a non-sulfide mineral is selected for treatment. Such minerals include phosphate rock, foskorite, apatite, fluorite, barite, taconite, magnetite, hematite, and such other non-sulfide ores as are conventionally processed by froth flotation using a fatty acid collector. The selected mineral is sized to provide particles of flotation size according to conventional procedures. Generally, the flotation size will encompass from about 1 mm to about 150 mesh size.

After the selected non-sulfide mineral has been sized as indicated, it is slurried in aqueous medium and conditioned with effective amounts of collector combination, fuel oil, if necessary, and alkali as required in accordance with conventional procedures. Generally, the slurry is conditioned at pasty consistency in the range of about 50 to 75% solids, preferably about 65–75% solids, but such solids may vary widely depending upon the specific non-sulfide mineral being processed. Generally, the collector combination will be in the range of about 0.01 to 1.0 pounds per ton of mineral, although variations in amounts will arise depending upon the specific mineral being processed and the level of recovery desired. Fuel oil and alkali usage, when necessary, will be in accordance with conventional processing. Fuel oil is used to suppress froth formation and will vary as necessary depending upon the extent to which excessive frothing occurs.

Alkali usage will be within conventional limits and is that necessary to provide the pH value at which froth flotation is to be accomplished. The pH value of the slurry is generally on the alkaline side but specific values will vary depending upon the mineral processed and the combination of recovery and grade desired. Generally, the pH value will range from about 6.0 to 12.0, usually from about 8.0 to 10.0.

After the mineral has been suitable with the collector combination and optional additives, it is subjected to froth flotation in accordance with conventional procedures. The desired mineral values will float off with the froth leaving the gangue materials behind.

The invention is more fully illustrated in the examples which follow wherein all parts and percentages are by weight unless otherwise specified. Although the invention is illustrated with phosphate minerals as typical of the non-sulfide class, it is to be understood that similar benefits are obtained with other members of the class defined. The following general procedure is employed in the froth flotation examples given.

GENERAL PROCEDURE

Rougher Float

Step 1: Secure washed and sized feed, e.g., 35 × 150 mesh screen fractions. Typical feed is usually a mixture of 23% coarse with 77% fine flotation particles.

Step 2: Sufficient wet sample, usually 640 grams, to give a dry weight equivalent of 500 grams. The sample is washed once with about an equal amount of tap water. The water is carefully decanted to avoid loss of solids.

Step 3: The moist sample is conditioned for one minute with approximately 100 cc. of water, sufficient caustic as 5–10% aqueous solution to obtain the pH desired (pH 9.5–9.6) a mixture of 50% acid and fuel oil and additional fuel oil as necessary. Additional water may be necessary to give the mixture the consistency of "oatmeal" (about 69% solids). The amount of caustic will vary from 4 to about 20 drops. This is adjusted with a pH meter for the correct endpoint. At the end of the conditioning, additional caustic may be added to adjust the endpoint. However, an additional 15 seconds of conditioning is required if additional caustic is added to adjust the pH. Five to about 200 drops of acid-oil mixture and one-half this amount of additional oil is used, depending on the treatment level desired.

Step 4: Conditioned pulp is placed in an 800-gram bowl of a flotation machine and approximately 2.6 liters of water are added (enough water to bring the pulp level to lip of the container). The percent solids in the cell is then about 14%. The pulp is floated for 2 minutes with air introduced after 10 seconds of mixing. The excess water is carefully decanted from the rougher products. The tails are set aside for drying and analysis.

Step 5: The products are oven dried, weighed, and analyzed for weight percent $P_2O_5$ or BPL. Recovery of mineral values is calculated using the formula:

$$\frac{(W_c)(P_c)}{(W_c)(P_c) + (W_t)(P_t)} \times 100$$

wherein $W_c$ and $W_t$ are the dry weights of the concentrate and tailings, respectively, and $P_c$ and $P_t$ are the weight percent $P_2O_5$ or BPL of the concentrate or tails, respectively.

EXAMPLE 1

Using a phosphate ore obtained from Hooker's Prairie Mine, the General Procedure was followed using in one run a tail oil fatty acid alone as the conditioner and in a second run a combination of the same fatty acid and tetrasodium-N-(1,2 dicarboxyethyl)-N-octadecylsulfosuccinamate was used. In each run recycled motor oil was used in conjunction with the conditioner and sufficient caustic to provide a pH of 9.0. Results and dosage levels of the ingredients are given in Table I which follows.

TABLE I

| Collector | lbs./ton | Prairie Mine Feed Recycled Motor Oil lbs./ton | Weight Recovery(%) | %BPL Feed | Tail | Conc. | Recovery %BPL |
|---|---|---|---|---|---|---|---|
| Tall Oil Fatty Acid | 1.0 | 2.0 | 14.41 | 11.68 | 4.92 | 51.81 | 63.9 |
| Tall Oil Fatty Acid plus tetrasodium (N-1,2-dicarboxyethyl)-N-octadecylsulfosuccinamate | 0.9<br>0.035 | 2.0 | 18.71 | 12.63 | 3.29 | 53.19 | 78.8 |

These results show that the use of about 3.7% of an N-sulfodicarboxylic acid aspartate of the present invention for 10% of the conventional fatty acid results in a 23.3% of increase in bone phosphate of lime (BPL) recovery in spite of the fact that total collector dosage was reduced by 6.5%, a highly unexpected result.

EXAMPLE 2

Using a phosphate ore obtained from the Brewster, Florida deposits, the General Procedure was again followed. In one run a tall oil fatty acid was used alone as conditioner and in another run a combination of the same fatty acid and tetrasodium N-(1,2-dicarboxyethyl)-N-octadecylsulfosuccinamate was used. In each run No. 5 Fuel Oil was used in conjunction with the conditioner and sufficient caustic to provide a pH of 9.0. Details and results are given in Table II which follows.

TABLE II

| Collector | lbs./ton | Brewster Phosphate No. 5 Fuel Oil lb./ton | Weight Recovery% | %BPL Feed | Tail | Conc. | Recovery %BPL |
|---|---|---|---|---|---|---|---|
| Tall Oil Fatty Acid | 0.5 | 0.5 | 16.64 | 17.78 | 7.67 | 63.43 | 64.04 |
| Tall Oil Fatty Acid plus tetradosium N-(1,2-dicarboxyethyl)-N-octadecylsulfosuccinamate | 0.475<br>0.025 | 0.5 | 19.65 | 17.46 | 5.00 | 68.43 | 77.00 |

Again, the booster action of small amounts of an N-sulfodicarboxylic acid aspartate of the present invention is shown, a 20% increase in recovery.

EXAMPLE 3

The ore of Example 1 was again used. In one run the ore was treated using a tall oil fatty acid, recycled motor oil and ammonia to pH 9.0. In other runs, half of the standard quantity of fatty acid was eliminated and in its place was used a small quantity of an N-sulfodicarboxylic acid aspartate of the invention. Details and results are given in Table III which follows.

TABLE III

| Fatty Acid | lbs./ton | Booster | lbs./ton | Prairie Mine Feed Weight Recovery% | %BPL Feed | Tail | Conc. | Recovery BPL% |
|---|---|---|---|---|---|---|---|---|
| Tall Oil | 1.4 | 0 | 0 | 23.9 | 19.1 | 9.1 | 54.9 | 62.8 |
| Tall Oil | 0.7 | A | 0.035 | 21.9 | 19.1 | 7.3 | 56.3 | 71.0 |
| Tall Oil | 0.7 | B | 0.035 | 24.9 | 19.1 | 5.3 | 54.1 | 80.1 |

Booster A = Tetrasodium N-(1,2-dicarboxyethyl)-N-octadecylsulfosuccinamate
B = Tetrasodium N-(1,2-dicarboxyethyl)-N-octadecenylsulfosuccinamate.

EXAMPLE 4

Following the procedure of Example 3, a series of flotations were run using a crude tall oil fatty acid alone and in combination with tetrasodium N-(1,2-dicarboxyethyl)-N-octadecyl sulfosuccinamate to show the synergistic results obtained with the combination. Details and results are shown in Table IV.

TABLE IV

| Fatty Acid[2] | lbs./ton | Booster | lbs./ton | Prairie Mine Feed Weight Recovery% | %BPL Feed | Tail | Conc. | Recovery BPL% |
|---|---|---|---|---|---|---|---|---|
| Tall Oil | 0.3 | — | — | 0.08 | 14.31 | 14.30 | 22.32 | 0.12 |
| Tall Oil | 0.4 | — | — | 4.41 | 14.66 | 12.70 | 57.19 | 17.20 |
| Tall Oil | 0.5 | — | — | 18.88 | 15.28 | 9.18 | 50.07 | 61.89 |
| Tall Oil | 0.38 | A[1] | 0.02 | 13.36 | 13.67 | 5.65 | 65.68 | 64.19 |
| Tall Oil | 0.36 | A | 0.04 | 18.53 | 14.89 | 5.41 | 56.55 | 70.39 |
| Tall Oil | 0.32 | A | 0.08 | 19.10 | 14.88 | 4.91 | 57.13 | 73.31 |
| Tall Oil | 0.28 | A | 0.12 | 21.61 | 15.48 | 4.48 | 55.37 | 70.31 |
| Tall Oil | 0.24 | A | 0.16 | 19.64 | 15.05 | 4.91 | 56.55 | 73.79 |
| Tall Oil | 0.20 | A | 0.20 | 21.78 | 15.30 | 4.47 | 54.19 | 77.15 |
| Tall Oil | 0.16 | A | 0.24 | 20.74 | 15.56 | 5.02 | 55.84 | 74.43 |
| Tall Oil | 0.12 | A | 0.28 | 19.10 | 14.84 | 5.02 | 56.43 | 72.63 |
| Tall Oil | 0.08 | A | 0.32 | 21.36 | 14.56 | 4.47 | 51.72 | 75.86 |
| Tall Oil | 0.04 | A | 0.36 | 19.82 | 15.44 | 5.58 | 55.31 | 71.02 |

TABLE IV-continued

| | | | Prairie Mine Feed | | | | | |
|---|---|---|---|---|---|---|---|---|
| Fatty Acid[2] | lbs./ ton | Booster | lbs./ ton | Weight Recovery% | %BPL Feed | Tail | Conc. | Recovery BPL% |
| Tall Oil | — | A | 0.40 | 5.50 | 14.62 | 12.42 | 52.42 | 19.72 |

Notes:
[1]A = TETRASODIUM N-(1,2-DICARBOXYETHYL)-N-OCTADECYL SULFOSUCCINAMATE
[2]RECYCLED MOTOR OIL ALSO USED AT DOUBLE THE DOSAGE OF COLLECTOR OR COMBINATION

EXAMPLES 5–9

Following the procedure of Example 3, a number of additional N-sulfodicarboxylic acid aspartates are evaluated as boosters for fatty acid collectors. In each instance, a boostering effect is obtained. The compounds evaluated in each example number are listed below.

Example 5 - Tetrasodium N-(1,2-dicarboxyethyl)-N-hexadecylsulfosuccinamate.

Example 6 - Tetrasodium N-(1,2-dicarboxyethyl)-N-tetradecylsulfosuccinamate.

Example 7 - Tetrasodium N-(1,2-dicarboxyethyl)-N-dodecylsulfosuccinamate.

Example 8 - Tetrasodium N-(1,2-dicarboxyethyl)-N-decylsulfosuccinamate.

Example 9 - Tetrasodium N-(1,2-dicarboxyethyl)-N-octylsulfosuccinamate.

I claim:

1. A collector combination for non-sulfide minerals comprising from about 1 to 99 weight percent of a fatty acid derived from a vegetable or mineral oil, said acid being present in hydrogen form or as an alkali metal or ammonium salt, and, correspondingly, from about 99 to about 1 weight percent of an N-sulfodicarboxylic acid aspartate of the general formula:

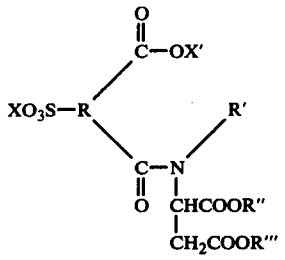

wherein X and X' are members of the group consisting of hydrogen and cationic salt-forming radicals, R is the residue of an aliphatic polycarboxylic acid resulting from removal therefrom of a sulfonic acid group and two carboxylic acid groups, R' is a member of the group consisting of alkyl, alkoxyalkyl and hydroxyalkyl radicals of from 8 to 20 carbon atoms, and R'' and R''' are members of the group consisting of hydrogen, alkyl and cationic salt-forming radicals, said N-sulfodicarboxylic acid asparate being in a form compatible with the form of said fatty acid.

2. The composition of claim 1 wherein said fatty acid is a tall oil fatty acid.

3. The composition of claim 1 wherein R' is octadecyl.

4. The composition of claim 1 wherein R' is octadecenyl.

5. The composition of claim 2 wherein R' is octadecyl.

6. The composition of claim 1 wherein the weight percent of fatty acid is from about 90 to 97 and, correspondingly, the weight percent of N-sulfodicarboxylic acid aspartate is from about 10 to 3.

* * * * *